United States Patent [19]

Brown

[11] 4,007,599

[45] Feb. 15, 1977

[54] MARINE PLATFORM

[76] Inventor: Robert L. Brown, 27594 Parkview Blvd., Warren, Mich. 48092

[22] Filed: Dec. 8, 1975

[21] Appl. No.: 638,353

[52] U.S. Cl. ..... 61/104; 61/48; 9/8 P; 114/220; 114/230

[51] Int. Cl.[2] ..... B63B 21/00; E02B 3/22

[58] Field of Search ..... 61/46, 48, 46.5; 114/230, 220, .5 F, 219; 52/65; 9/8 P

[56] References Cited

UNITED STATES PATENTS

| | | | |
|---|---|---|---|
| 3,055,182 | 9/1962 | Slemmons | 61/48 |
| 3,383,870 | 5/1968 | Costello | 61/48 |
| 3,461,828 | 8/1969 | Bielstein | 61/46.5 X |
| 3,595,196 | 7/1971 | Riffeser | 114/230 |

*Primary Examiner*—Jacob Shapiro
*Attorney, Agent, or Firm*—Webster B. Harpman

[57] ABSTRACT

A marine platform for offshore installation has a fixed central platform and an annular arrangement of floating dock units positioned thereabout arranged for movement therearound and vertical movement responsive to wave and water level changes. The annular arrangement of floating dock units accommodate the docking of ships and barges which may be rotated about the marine platform by rotary motion imparted the dock units.

6 Claims, 4 Drawing Figures

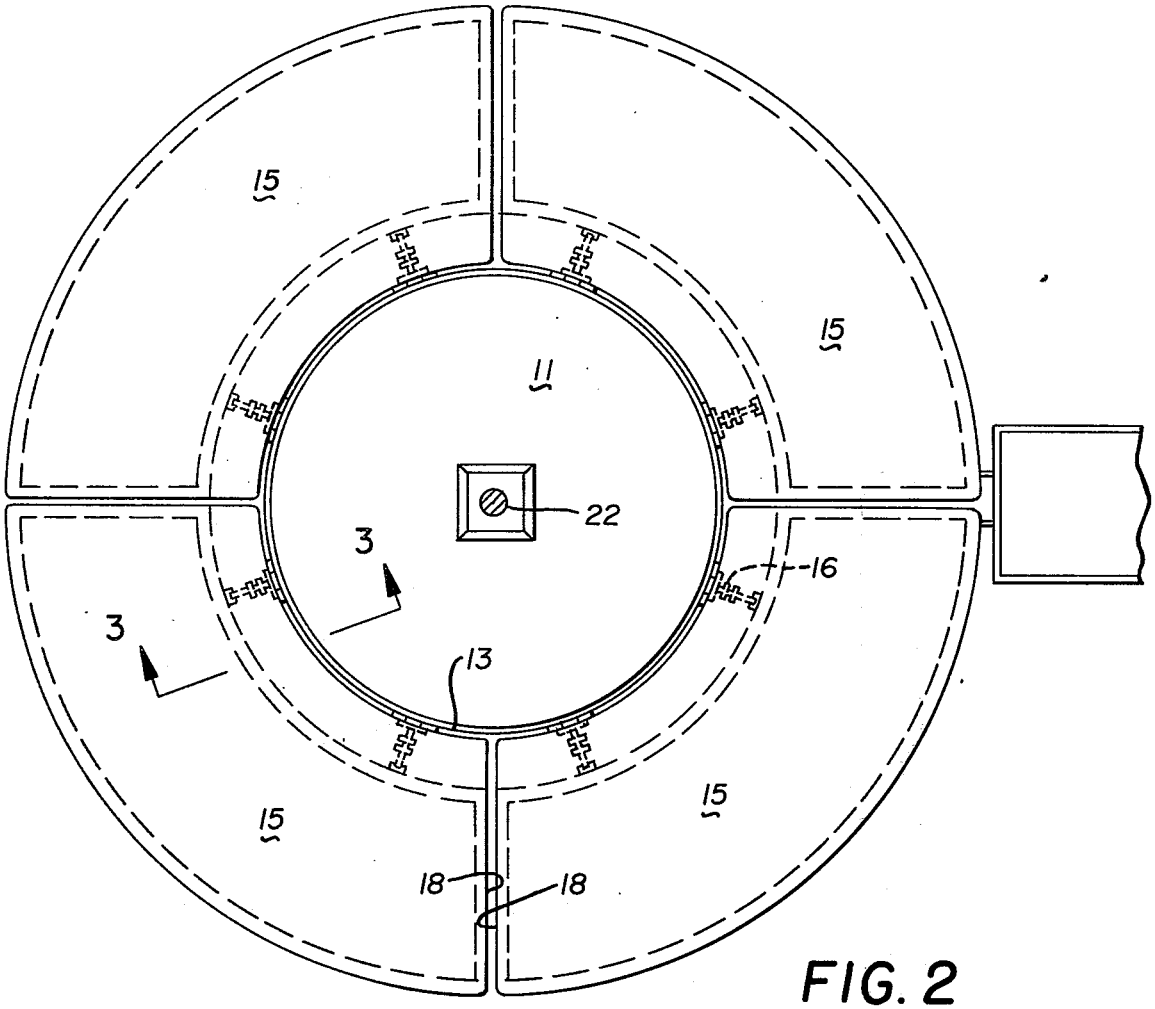
FIG. 2
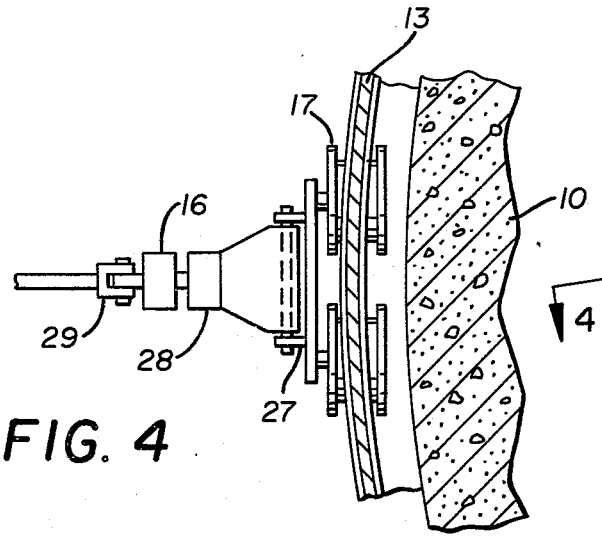
FIG. 4
FIG. 3
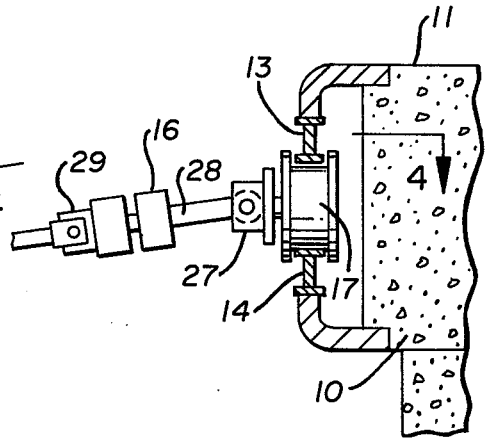

MARINE PLATFORM

BACKGROUND OF THE INVENTION

1. Field of the Invention

This invention relates to marine platforms for offshore installation as for example on the sea bed or river bed to provide ship and/or barge docking facilities.

2. Description of the Prior Art

Prior structures of this type have generally related to fixed and/or floating docks or platforms. U.S. Pat. No. 3,672,178 discloses a circular floating dock in a protected environment and rotatable about a fixed piling or the like. Variations include radially extending docks forming boat slips therebetween. A similar arrangement in a floating platform is seen in U.S. Pat. No. 3,521,588 and a fixed offshore ship mooring installation may be seen in U.S. Pat. No. 3,563,041.

This invention provides a marine platform with the advantages of a fixed or stationary platform on which a crane or the like may be positioned.

SUMMARY OF THE INVENTION

A marine platform takes the form of a stationary cylindrical structure having a closed upper end with annular guides thereabout together with a plurality of arcuate shaped floating platforms defining a circle in assembly individually secured by flexible means to the annular guides about the stationary cylindrical structure, the arrangement being such that the arcuate shaped floating platforms can be rotated about the stationary cylindrical support and they are free to rise and fall individually responsive to wave motion or water level changes. Each of the floating platforms provides docking space for ships or barges and means is included in the stationary cylindrical structure for rotating the floating platforms thereabout so as to enable the ships or barges secured to the floating platforms to be desirably positioned upstream, downstream or down wind as the case may be.

DESCRIPTION OF THE DRAWINGS

FIG. 2 is a top plan view of the marine platform seen in FIG. 1 with parts broken away and in cross section;

FIG. 3 is an enlarged cross sectional detail on line 3—3 of FIG. 2; and

FIG. 4 is an enlarged horizontal section on line 4—4 of FIG. 3.

DESCRIPTION OF THE PREFERRED EMBODIMENT

Figure 1:
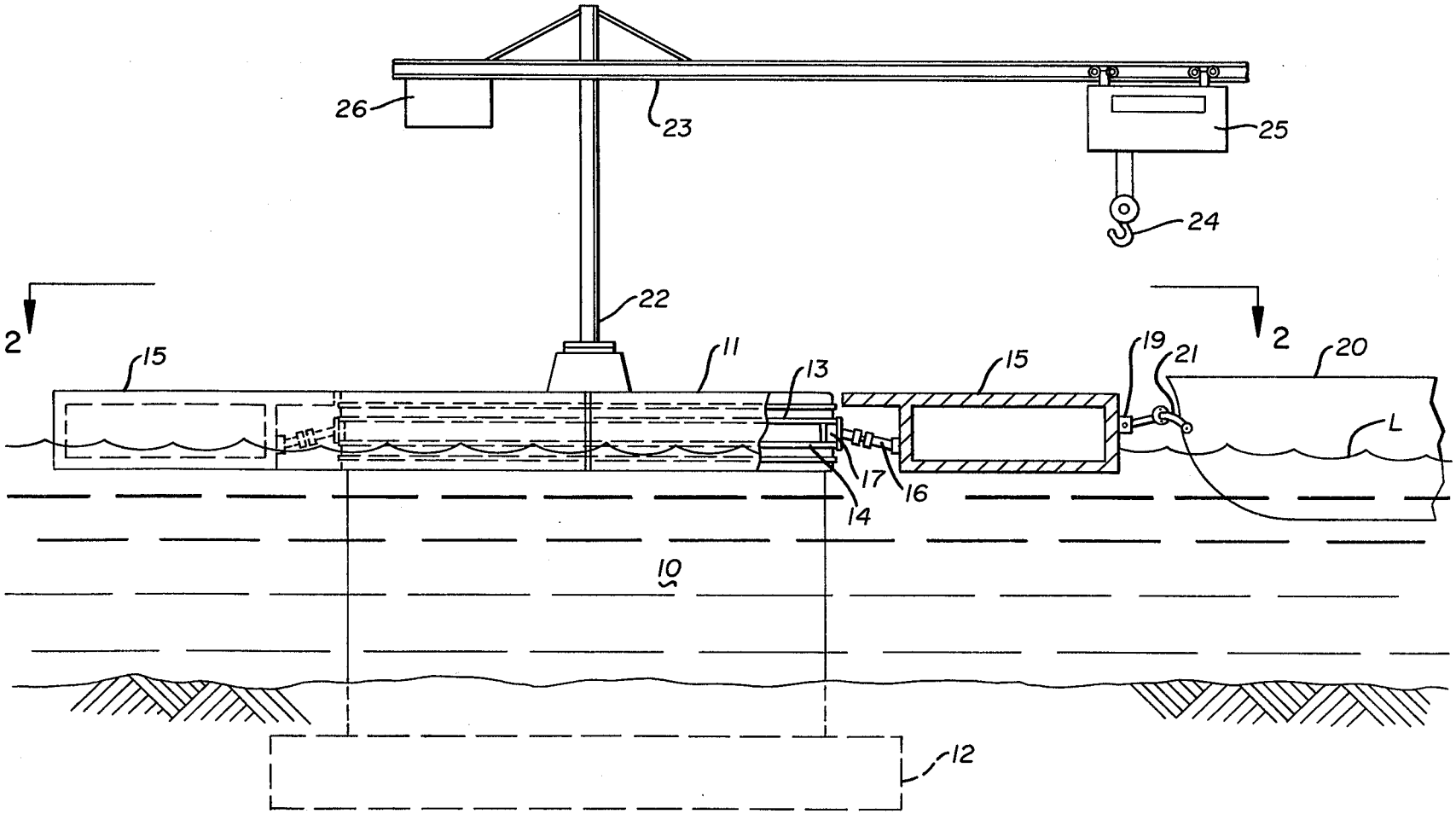
FIG. 1 is a side elevation with parts in cross section and parts broken away illustrating the marine platform embodying the present invention.

In the form of the invention chosen for illustration herein, the marine platform as best illustrated in FIG. 1 of the drawings comprises a stationary center platform 10 preferably cylindrical in structure and having a closed top 11 and an enlarged under water base 12 positioned on or in the sea bed or river bed. The height of the stationary central platform 10 is greater than the normal water level L. A pair of oppositely disposed vertically spaced guide rails 13 and 14 extend continuously in an annular pattern around the upper side walls of the stationary central platform 10 at a point above the normal water level L and a plurality of floating dock units 15 are positioned in a circle around the stationary central platform 10 and flexibly secured thereto by a plurality of devices 16, each of which includes at least one flanged rotary member 17 positioned between and engaged upon the annular guide rails 13 and 14.

By referring now to FIG. 2 of the drawings, it will be seen that each of the floating dock units 15 is arcuate in shape and defines a segment of a circle and is arranged in the circle about the stationary central platform 10 with the respective ends 18 of the floating dock units 15 in spaced relation to one another.

By referring again to FIG. 1 of the drawings, it will be seen that the outermost sides of the floating dock units 15 are provided with attachment devices 19 by which a ship or a barge 20 or the like can be secured thereto by a coupling device 21.

In FIG. 1 of the drawings a crane, including a vertical support 22, is shown centrally located on the stationary central platform 10, the crane including a horizontal support 23, a vertically movable hook 24 and mechanism 25 for moving the same together with a counter weight 26 as customary in crane constructions. It will occur to those skilled in the art that such a crane can swing around the marine platform disclosed herein and load and unload cargo from ships or barges secured thereto. Alternately the crane may comprise an overhead tramway extending shoreward as will occur to those skilled in the art.

The flexible devices 16 which connect the floating dock units 15 to the stationary central platform 10 by way of the annular guide rails 13 and 14 are such that they permit the floating dock units 15 to move responsive to wave motion and changes in water level. A detail of one form of such a device may be seen in FIG. 3 of the drawings, and by referring thereto it will be noted that the flanged rotary member 17 is doubly flanged with the flanges being spaced and engaged on the inner and outer surfaces of the vertically spaced guide rails 13 and 14. The rotary member 17 has an axle bracket 27 to which an extensible arm 28 is pivotally affixed. A swivel coupling 29 or the like is carried on the a part of the extensible arm 28 and is attached to the near side of one of the floating dock units 15.

As seen in FIG. 2 of the drawings, a plurality of these flexible connectors generally indicated at 16 extend between the several floating dock units 15 and the annular guide rails 13 and 14. Means not shown is preferably incorporated in the stationary central platform 10 for imparting motion to the rotary members 17 and so as to make possible the rotation of the floating dock units 15 about the stationary central platform 10. Such rotation will move boats or barges tied up to the floating dock units 15 relative to the stationary central platform 10 as may obviously be desirable to position the ships or barges down wind with respect thereto or to move them inunder the crane heretofore described or its tramway alternate.

It will occur to those skilled in the art that if no apparatus is provided for imparting rotary motion to the floating dock units 15, a power boat, tug or the like can be used to rotate the assembly of floating dock units 15 and ships or barges tied thereto.

It will also occur to those skilled in the art that the stationary central platform 10 may be formed of steel or concrete, it may be solid or hollow and that the floating dock units 15 may be similarly formed of steel or concrete or alternately buoyant materials.

The above described marine platform provides a practical, relatively inexpensive offshore docking facility for ships or barges or the like, and makes possible the relocation of the ships or barges as may be desirable and at the same time accommodates changes in the sea or water level and provides for yielding resistance to wave motion and the like. It may be formed in various sizes and heights for various specific functions.

Although but one embodiment of the present invention has been illustrated and described, it will be apparent to those skilled in the art that various changes and modifications may be made therein without departing from the spirit of the invention and having thus described my invention what I claim is:

1. A marine platform comprising a stationary central platform having an upright axis, said platform having an uppermost portion of annular configuration, continuous annular guide means on said annular portion and a plurality of floating dock units arranged in a circle around said stationary central platform, flexible means movably engaged in said annular guide means and connected with said floating dock units, said flexible means positioning said floating dock units in closely spaced relation to said annular guide means and said stationary central platform for free rotary movement thereabout and free vertical movement relative thereto.

2. The marine platform of claim 1 and wherein said flexible means comprises a plurality of flanged rotary members engaged between said continuous annular guide means and members extending from said rotary members and movably attached to said floating dock units.

3. The marine platform of claim 2 and wherein said last mentioned members comprise a plurality of extensible arms, pivots on said arms in oppositely disposed relation to said flanged rotary members and engaging said floating dock units, so as to space the same from each other and the central platform.

4. The marine platform of claim 1 and wherein said floating dock units are arcuate in shape and form segments of a continuous circle about said central platform.

5. The marine platform of claim 1 and wherein said central platform is cylindrical and has a closed flat upper end.

6. The marine platform of claim 1 and wherein said continuous annular guide means comprise vertically spaced annular rails secured to said central platform in spaced relation thereto.

* * * * *